US009879471B2

(12) United States Patent
Lewis et al.

(10) Patent No.: US 9,879,471 B2
(45) Date of Patent: Jan. 30, 2018

(54) REINFORCED FOLDING DOOR AND HINGE ASSEMBLY

(71) Applicant: Woodfold Mfg., Inc., Forest Grove, OR (US)

(72) Inventors: Mark F. Lewis, Portland, OR (US); Rick Scott Alvarado, Gaston, OR (US)

(73) Assignee: WOODFOLD MFG., INC., Forest Grove, OR (US)

( * ) Notice: Subject to any disclaimer, the term of this patent is extended or adjusted under 35 U.S.C. 154(b) by 0 days.

(21) Appl. No.: 15/171,478

(22) Filed: Jun. 2, 2016

(65) Prior Publication Data

US 2017/0089122 A1 Mar. 30, 2017

Related U.S. Application Data

(60) Provisional application No. 62/235,455, filed on Sep. 30, 2015.

(51) Int. Cl.

| | |
|---|---|
| ***E05D 3/02*** | (2006.01) |
| ***E06B 3/48*** | (2006.01) |
| ***E05D 15/26*** | (2006.01) |

(52) U.S. Cl.

CPC ..... *E06B 3/481* (2013.01); *E05D 3/02* (2013.01); *E05D 15/26* (2013.01); *E05Y 2900/132* (2013.01)

(58) Field of Classification Search

CPC .. E06B 3/481; E04D 3/02; E04D 3/04; E04D 15/26; E04D 11/06

See application file for complete search history.

(56) References Cited

U.S. PATENT DOCUMENTS 1,463,346 A * 7/1923 Walker ..... E06B 3/481 16/DIG. 31
3,131,753 A * 5/1964 Dixon ..... E06B 3/481 16/225

(Continued)

OTHER PUBLICATIONS

Lewis, "Hinge Knuckle for Folding Door Assembly", U.S. Appl. No. 29/568,458, filed Jun. 17, 2016.

(Continued)

*Primary Examiner* — Katherine W Mitchell
*Assistant Examiner* — Abe Massad
(74) *Attorney, Agent, or Firm* — Stoel Rives LLP

(57) ABSTRACT

An accordion type folding door system having a plurality of elongated panels hinged together along their longitudinal side edges into a pleated or zig zag arrangement, the folding panels being interconnected by a hinge assembly. The hinge assembly is disposed between and interconnects a pair of adjacent panels, each of the pair of interconnected adjacent panels including a side edge having longitudinal groove and an extension flange, wherein the hinge assembly includes a hinge pin and a plurality of hinge knuckles disposed vertically end-to-end in alternating arrangement on the hinge pin, the hinge knuckle having a tubular central opening for accepting the hinge pin, an outwardly extending tongue for connecting to a corresponding longitudinal groove in an adjacent panel in a tongue and groove connection, and an outwardly flared wedge that extends beyond the extension flanges of the panels, whereby the wedge cooperates with the extension flanges to limit angular folding extension to a maximum desired angle.

7 Claims, 11 Drawing Sheets

(56) References Cited

U.S. PATENT DOCUMENTS

| | | | | | |
|---|---|---|---|---|---|
| 3,901,302 | A * | 8/1975 | Dagenais | E05D 3/02 | 16/263 |
| 3,913,171 | A * | 10/1975 | Reid | E05F 5/06 | 16/342 |
| 4,222,428 | A * | 9/1980 | Scherer | E05D 1/02 | 160/231.1 |
| 4,387,760 | A * | 6/1983 | Greschbach | E05D 1/04 | 160/199 |
| 4,922,987 | A | 5/1990 | Marontate et al. | | |
| 4,998,941 | A * | 3/1991 | Smith | E05D 11/06 | 16/374 |
| 5,150,501 | A | 9/1992 | Pasternak | | |
| 5,472,037 | A | 12/1995 | Hoffman | | |
| D370,839 | S | 6/1996 | Harris | | |
| 5,549,148 | A | 8/1996 | Figueiredo et al. | | |
| D402,536 | S | 12/1998 | Cousins | | |
| D411,434 | S | 6/1999 | Russell | | |
| 6,669,272 | B2 * | 12/2003 | Ayabe | B60J 5/0487 | 180/89.12 |
| D496,248 | S | 9/2004 | Liebendorfer | | |
| D520,862 | S | 5/2006 | Munson | | |
| 7,290,581 | B2 | 11/2007 | Lee | | |
| D562,108 | S | 2/2008 | Pester | | |
| 8,191,603 | B1 | 6/2012 | Motosko | | |
| D680,419 | S | 4/2013 | Green | | |
| 8,960,257 | B2 | 2/2015 | Goodman | | |
| D729,605 | S | 5/2015 | Ramey | | |
| D731,296 | S | 6/2015 | Nelson | | |
| D732,703 | S | 6/2015 | Kreutzman | | |
| 2005/0063058 | A1 | 3/2005 | Langley | | |
| 2011/0155145 | A1 | 6/2011 | Chua | | |
| 2012/0124776 | A1 * | 5/2012 | McDonnell | E05D 11/06 | 16/375 |
| 2014/0367056 | A1 | 12/2014 | Miller | | |

OTHER PUBLICATIONS

Notice of Allowance from Lewis et al. U.S. Appl. No. 29/568,458, dated Apr. 14, 2017, 11 pages.

* cited by examiner

REINFORCED FOLDING DOOR AND HINGE ASSEMBLY

RELATED APPLICATION DATA

This application claims priority under 35 U.S.C. § 119(e) to U.S. Provisional Application No. 62/235,455 filed on Sep. 30, 2015, hereby incorporated by reference.

BACKGROUND

The field of the present invention is directed to folding doors such as used for closets, elevators and room entrances.

An accordion type folding door comprises an assembly of vertically arranged panels placed side-by-side and suspended from a suitable track. The adjacent side edges of the panels are interconnected by sheet vinyl plastic hinges.

Alternately, the vinyl plastic hinges may be replaced as described in U.S. Pat. No. 4,922,987 with hinging assemblies that interconnect the panels, the hinging assemblies comprising a plurality of knuckles made of hard durable material (plastic or metal) and tongue and groove means for attachment of the knuckles to the side margins of the adjacent panels in an alternating arrangement, i.e., with alternate knuckles attached to the same panel, with a hinge pin made of steel or other stout material received in the knuckles. Though this design with the interconnection exhibits higher strength over the prior vinyl plastic hinge, the present inventor(s) have recognized potential for additional improvement.

Additional aspects and advantages will be apparent from the following detailed description of preferred embodiments, which proceeds with reference to the accompanying drawings.

DETAILED DESCRIPTION OF PREFERRED EMBODIMENTS

Preferred embodiments will now be described with reference to the drawings. To facilitate description, any element numeral representing an element in one figure will represent the same element in any other figure. The preferred embodiments will describe a particular folding door, but it will be appreciated that details of the system may be applied in other forms such as folding wall sections or the like.

Figure 1:
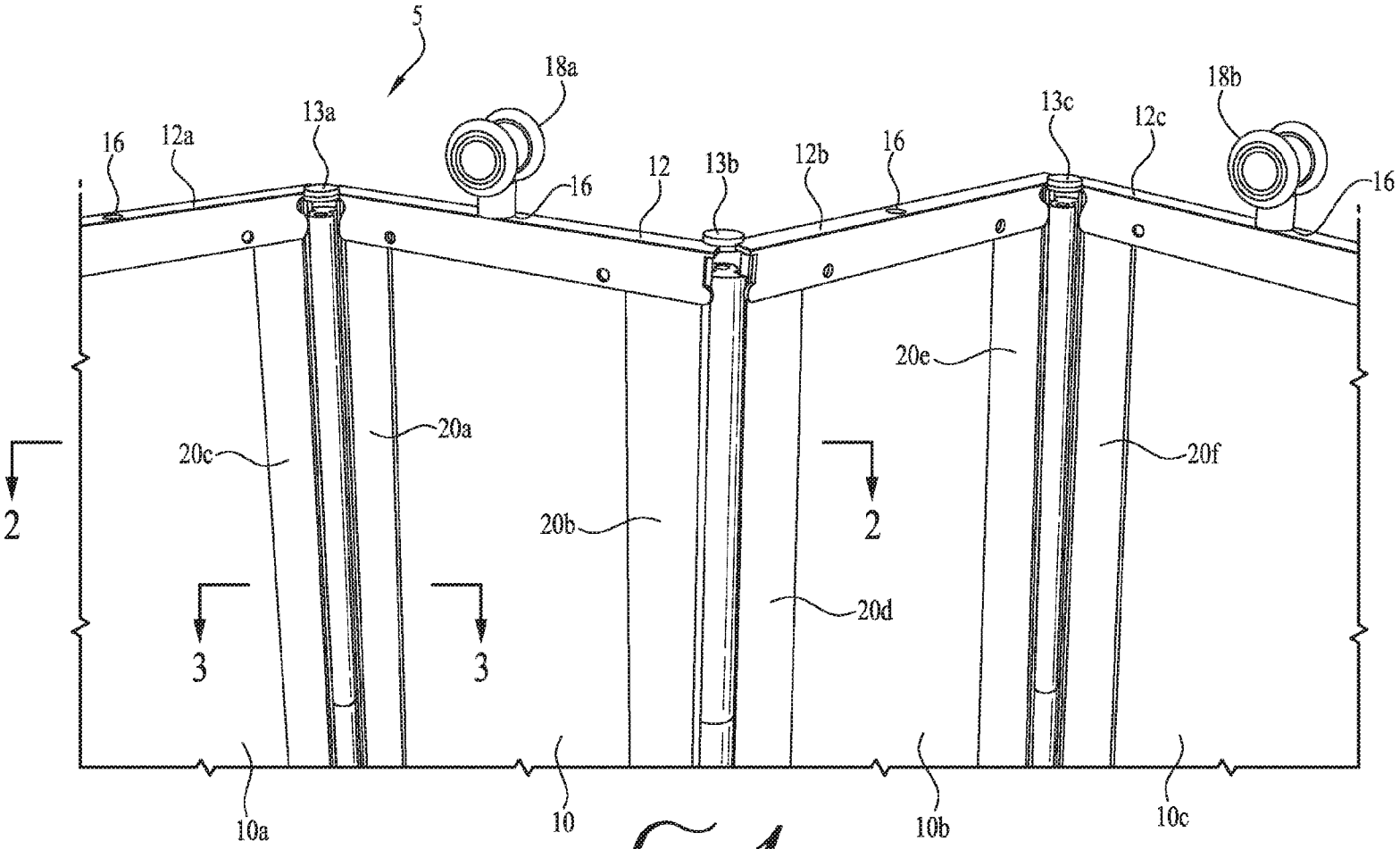
FIG. 1 is an isometric view of a top portion of a folding door assembly in an extended or closed position.
Figure 2:
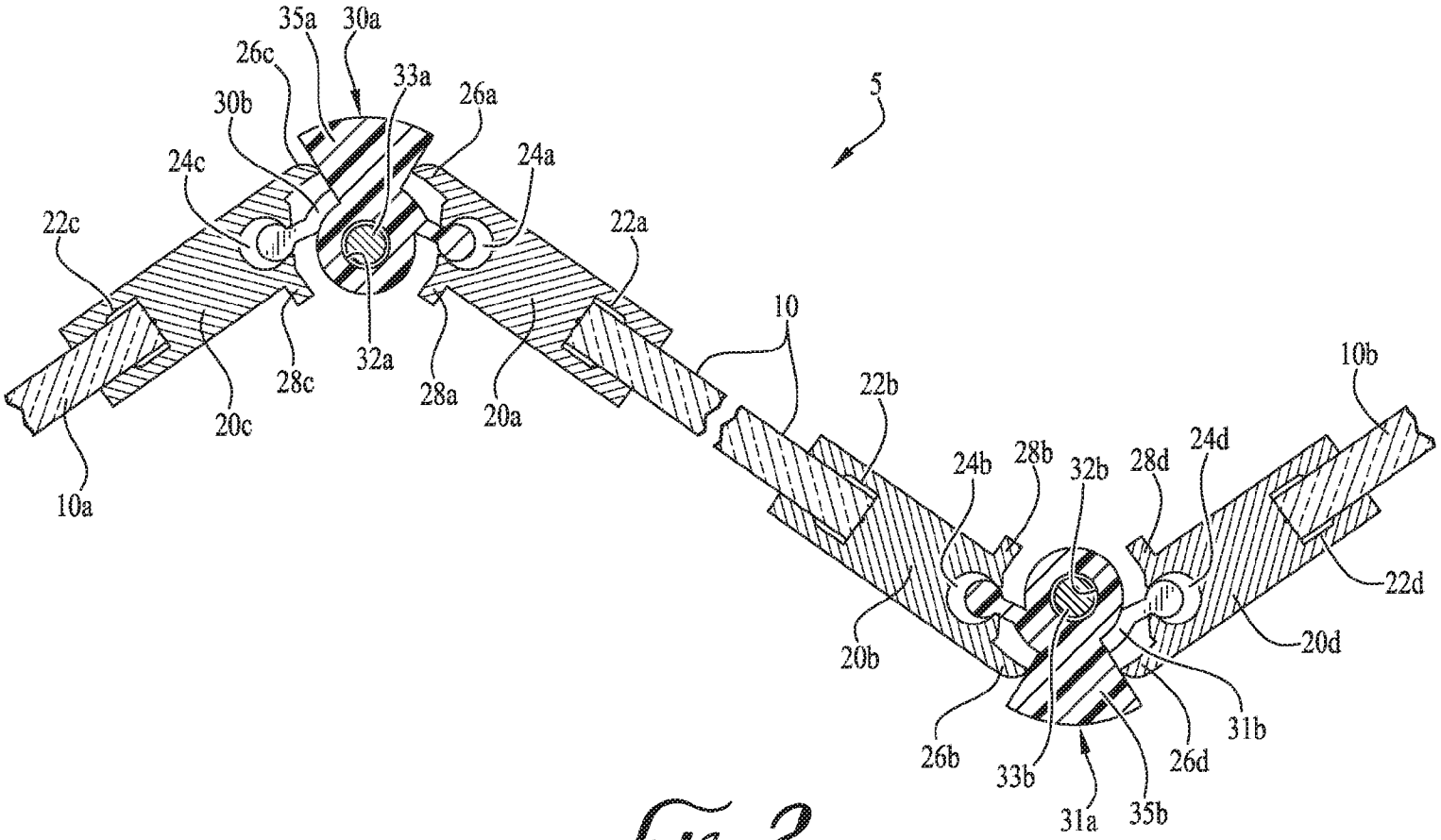
FIG. 2 is a cross-sectional view of the folding door assembly of FIG. 1 taken along line 2-2.
Figure 3:
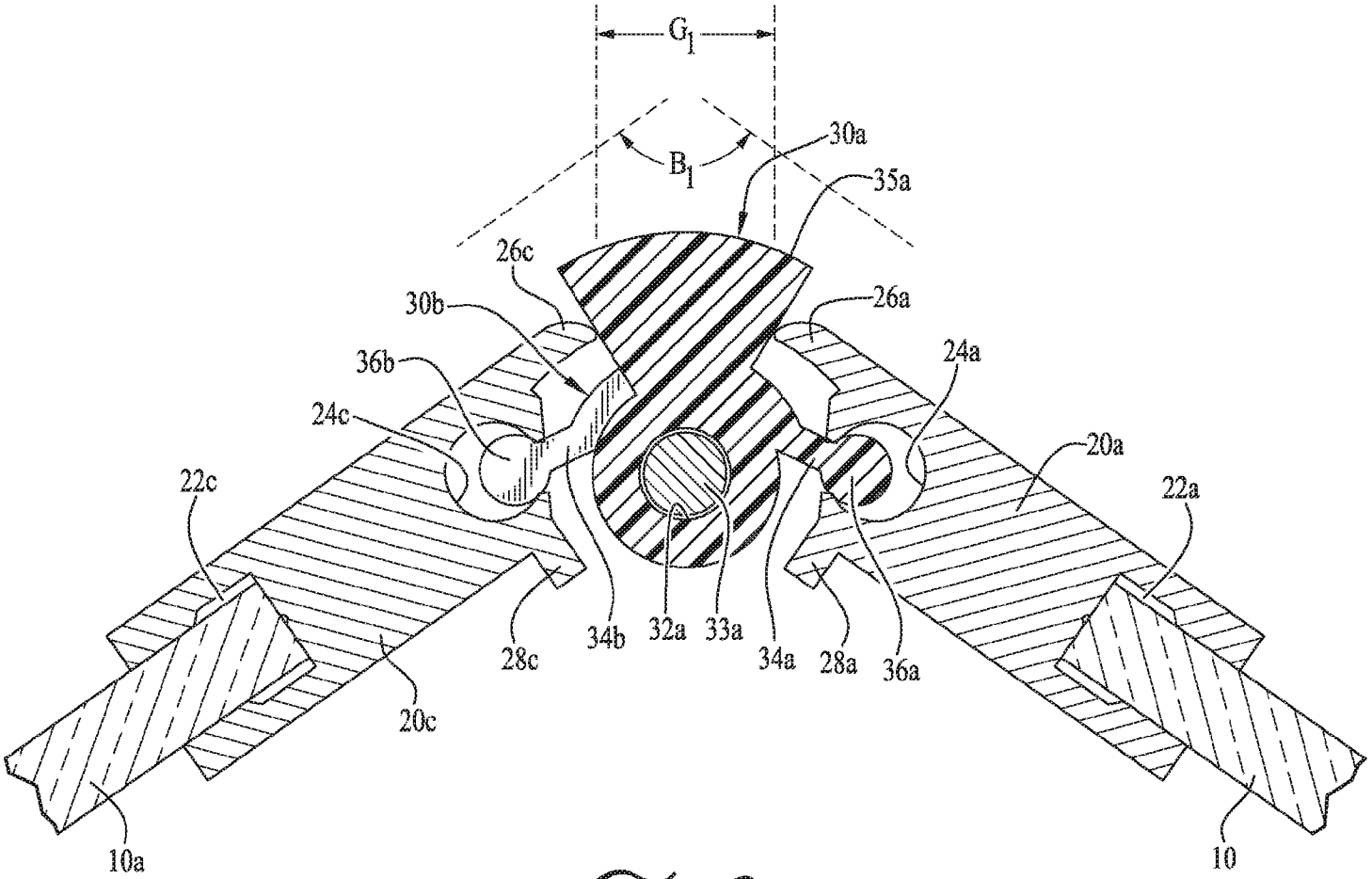
FIG. 3 is a partial cross-sectional view of a portion of the folding door assembly of FIG. 1 taken along line 3-3, on an enlarged scale.

FIGS. 1-3 illustrate an accordion type folding door system 5 according to a first embodiment. Certain features of the folding door system 5 are similar to those described in U.S. Pat. No. 4,922,987 hereby incorporated by reference. The folding door system 5 comprises a plurality of elongated panels 10 hinged together along their longitudinal side edges into the illustrated pleated or zig zag arrangement. Four panels 10, 10*a*, 10*b*, 10*c* are illustrated in FIG. 1, but there may be any suitable plurality of panels, two or more. The panels 10, 10*a*, 10*b*, 10*c* may comprise any suitable structural material, such as wood, particle board, clear or opaque plastic, or metal.

Panels 10, 10*a*, 10*b*, 10*c* are suitably framed, in part by cap pieces 12, 12*a*, 12*b*, 12*c* mounted on the top and bottom edges of each panel. The cap pieces 12, 12*a*, 12*b*, 12*c* may be channel-shaped (in cross-section) and receive the top and bottom margins of the respective panels 10, 10*a*, 10*b*, 10*c* In the first embodiment, the cap pieces 12, 12*a*, 12*b*, 12*c* are hinged together, hinges 13*a*, 13*b*, 13*c* connecting an adjacent pair of cap pieces. For example, the hinge 13*a* connects the cap piece 12*a* to the cap piece 12, the hinge 13*b* connects the cap piece 12 to the cap piece 12*b*, and the hinge 13*c* connects the cap piece 12*b* to the cap piece 12*c*. The hinges 13*a*, 13*b*, 13*c* are capped at the bottom and do not extend into the central hinge mechanisms described below. Such a construction may help prevent binding of adjacent cap pieces when folding.

The central segments of cap pieces 12, 12*a*, 12*b*, 12*c* are provided with openings 16. These openings provide means for mounting roller assemblies 18*a*, 18*b*, on selected panels (in the panel 10 and the panel 10*c*), by which the folding door system 5 is suspended on a ceiling track, not illustrated but of conventional construction. The ceiling track is mounted across the entrance of the space to be closed off by the folding door system 5.

The panels 10, 10*a*, 10*b*, 10*c* each includes longitudinal side framing members along panel side edges. Specifically, the panel 10 includes longitudinal side framing members 20*a*, 20*b*; the panel 10*a* includes longitudinal side framing member 20*c* (the other side framing member not shown); the panel 10*b* includes longitudinal side framing members 20*d*, 20*e*; and the panel 10*c* includes longitudinal side framing member 20*f* (the other side framing member not shown).

FIG. 2 is a cross section of FIG. 1 illustrating a portion of the hinge connections, three of the panels 10, 10*a*, 10*b* showing example construction. Each side framing member 20*a-d* may comprise a metal strip having the cross section as illustrated in FIG. 2. Each side framing member is shaped with an inner side margin provided with a respective longitudinal recess or groove 22*a-d*. The outer side margin of each panel 10, 10*a* or 10*b* may be dimensioned to fit into respective groove 22*a-d*, along with a quantity of adhesive for securing the panel into the groove.

Each side framing member 20*a-d* is also provided along its outer margin with a respective longitudinally extending groove 24*a*, 24*b*, 24*c*, 24*d*. Each of the side framing members 20*a-d* is also provided, along its sides, with a respective pair of longitudinally extending flanges. Framing member 20*a* has extending flanges 26*a*, 28*a*, framing member 20*b* has extending flanges 26*b*, 28*b*, framing member 20*c* has extending flanges 26*c*, 28*c*, and framing member 20*d* has extending flanges 26*d*, 28*d*. These flanges serve to shield the mechanism of the central hinge system by means of which two adjacent panels are coupled together in hinging relation.

Top hinges 13*a*, 13*b*, 13*c* provide the structural support for the door structure, by means of which the panels are hinged to each other in the desired configuration. A second hinging connection is provided by the central hinge system that may extend about the full length of the panels, from top to bottom.

In addition to providing a hinging function, the central hinging system may serve a barrier function, sealing off the space between adjacent panels in such a manner as to prevent access to the area behind the door. The central hinging system between adjacent framing members 20*a*, 20*c* of panels 10, 10*a* includes a plurality of hinge knuckles 30*a*, 30*b*, etc. and the central hinging system between adjacent framing members of panels 10, 10*b* includes a plurality of hinge knuckles 31*a*, 31*b*, etc. The hinge knuckle 30*a* includes an outwardly flared wedge section 35*a* and the hinge knuckle 30*b* disposed below the hinge knuckle 30*a* also includes an outwardly flared wedge section (not visible). A similar plurality of hinge knuckles 31*a*, 31*b* are shown in FIG. 2 between adjacent framing members 20*b*, 20*d* of panels 10, 10*b*. The hinge knuckle 31*a* includes an outwardly flared wedge section 35*b* and the hinge knuckle 31*b* disposed below the hinge knuckle 31*b* also includes an outwardly flared wedge section (not visible) Further details of the central hinging systems will now be described with respect to just one of the connections with reference to FIGS. 3-7 and 18 but the description equally applies to the other connections and panels in the folding door system 5.

As shown particularly in FIGS. 2-5, the central hinge assembly comprises a plurality of hinge knuckles 30*a*, 30*b* disposed end to end between each pair of adjacent framing members 20*a*, 20*c*, and a hinge pin 33*a* received within the central tubular openings of the knuckles (an opening 32*a* in hinge knuckle 30*a* is shown). Similarly as shown in FIG. 2, another central hinge assembly comprises a plurality of hinge knuckles 31*a*, 31*b* disposed end to end between a pair of adjacent framing members 20*b*, 20*d*, and a hinge pin 33*b* received within the central tubular openings of the knuckles (an opening 32*b* in hinge knuckle 31*a* is shown).

Figure 5:
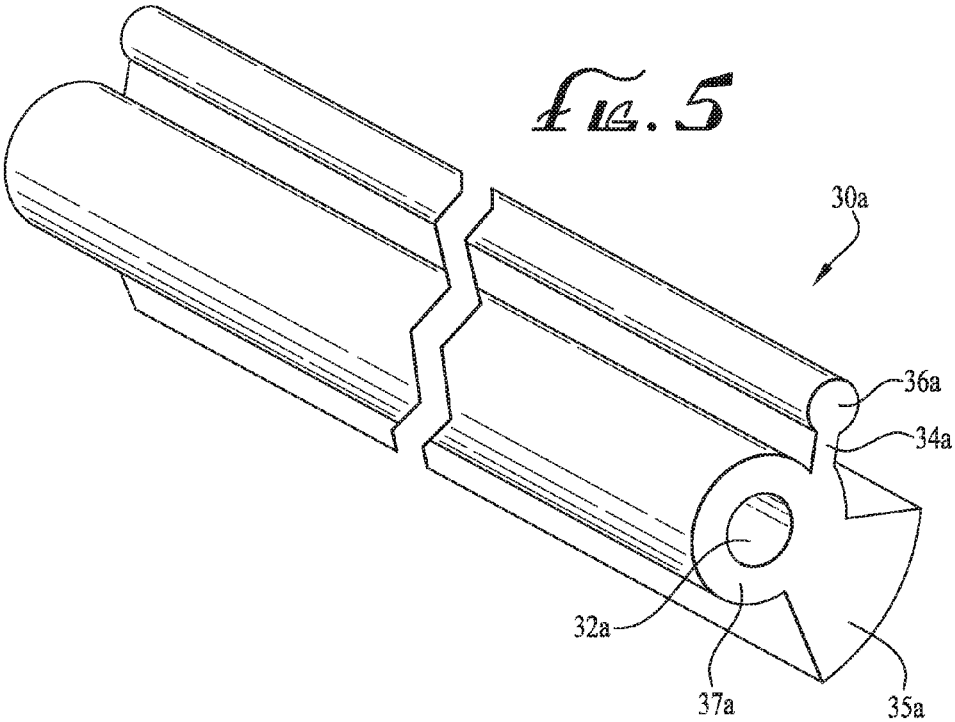
FIG. 5 is a perspective view of a hinge knuckle unit of the folding door assembly of FIG. 1.

FIG. 5 illustrates an example hinge knuckle 30*a*. The hinge knuckle 30*a* may be made of PVC plastic having desired properties of strength, rigidity, and temperature insensitivity. The element may be formed out of other suitable plastics, metals, or combinations. The PVC plastic may be formed in a desired color to match the panels sections for enhancing aesthetics. The hinge knuckle 30*a* is provided with a cylindrical central section 37*a* forming a central opening 32*a* and a longitudinally extending tongue 34*a* terminating in a bead 36*a* that nests within the longitudinally extending groove 24*a*. The hinge knuckle 30*a* also has an outwardly flared wedge section 35*a* that extends beyond the flanges 26*a*, 26*c*.

The tongue 34*a* of the hinge knuckle 30*a* with the associated bead 36*a* cooperates with the longitudinally extending groove 24*a* on the framing member 20*a* and a tongue 34*b* of the hinge knuckle 30*b* with an associated bead 36*b* cooperates with the longitudinal extending groove 24*c*, thereby collectively forming tongue and groove connections by means of which the hinge knuckles 30*a*, 30*b*, etc. are coupled to framing members 20*a*, 20*c*, in alternating positions/orientations. In other words, direction and connection of the beads will be arranged in an alternating fashion with one hinge knuckle connecting to a panel on one side and the next/adjacent hinge knuckle (above and below) connecting to the panel on the other side, thus forming the central hinge assembly of the hinge system. The beads 36*a*, 36*b* may be round rod shape (as illustrated) seating within the respective longitudinally extending grooves 24*a*, 24*c* that may be round, cylindrical shape, or the beads 36*a*, 36*b* may be other suitable shape such as T-shaped, disposed in a suitably-shaped groove.

Figure 18:
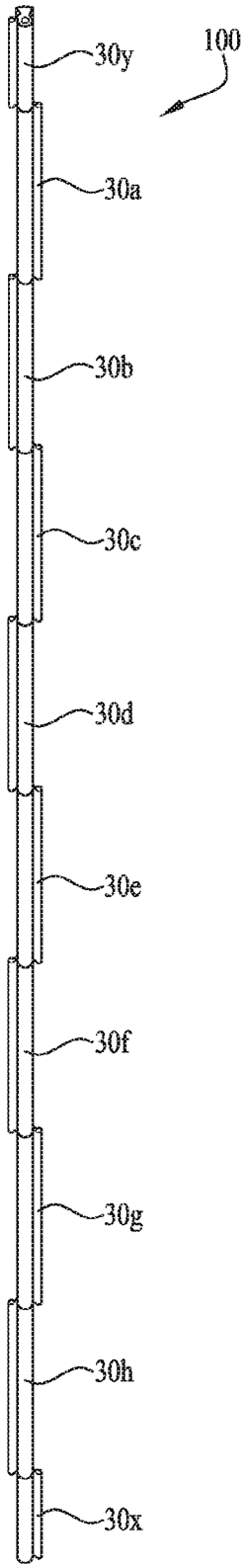
FIG. 18 is a diagrammatic view of a hinge knuckle arrangement for a folding door assembly according to an embodiment.

Though any number of hinge knuckle units, two or more, may serve the central hinge assembly function, multiple hinge knuckle units may provide advantages of strength and visibility blockage. As an example, for a typical height door of 78⅛ inches, seven full length (e.g., 10 inch long) hinge knuckles (arranged in alternating directions) may be stacked with a first partial length (e.g., 4 inch long) hinge knuckle on the top and a second partial length (4 inch long) hinge knuckle (e.g. hinge knuckle 30*x*) on the bottom. FIG. 18 illustrates an example hinge knuckle assembly 100 arrangement with eight full length (10 inch long) hinge knuckles 30*a*, 30*b*, 30*c*, 30*d*, 30*e*, 30*f*, 30*g*, 30*h*) arranged in alternating directions stacked with a first partial length (4 inch long) hinge knuckle 30*x* on the bottom and a second partial length (4 inch long) hinge knuckle 30*y* on the top, aligned and secured together by pin/post 33*a*. Other sizes (and numbers) of hinge knuckle units may be employed.

As previously mentioned, the hinge knuckle 30*a* may include an outwardly flared wedge section 35*a* that extends beyond the flanges 26*a*, 26*c*. The wedge section 35*a* cooperates with the flanges 26*a*, 26*c* (the flanges 26*a*, 26*c* contacting respective outer surfaces of the wedge section 35*a*) thereby limiting the minimum size of gap G1 and limiting the maximum angle B1 (see FIG. 3) that the folding door sections may extend to an angle B1 of about 110°. By limiting the angular un-folding extension to a desired maximum angle, and providing limiting resistance along the entire length of the door via operation of the wedge sections, the strength of the folding door assembly to resist horizontal pressure is enhanced. The wedge section 35*a* (of the hinge knuckle 30*a*) may be flared or pie-shaped as illustrated, or may alternately be square, rectangular, with curved sides or other suitable shape.

Figure 4:
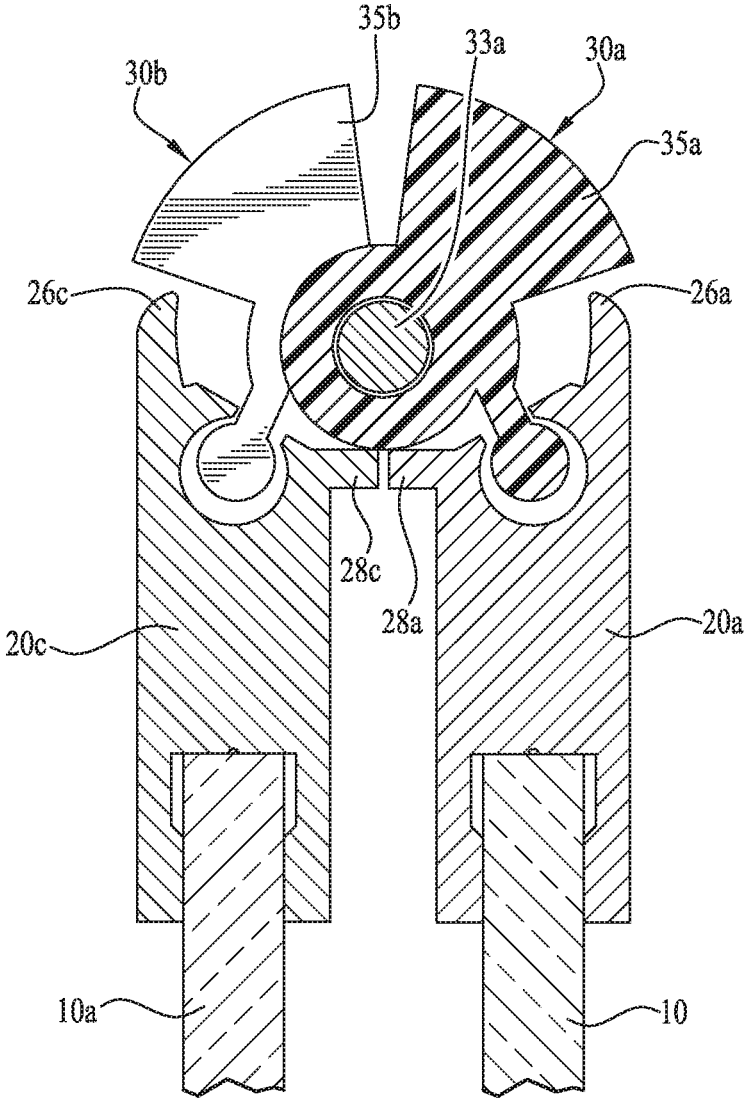
FIG. 4 is a partial cross-sectional view, similar to FIG. 3, but with the door in a folded or open position.

While FIG. 3 illustrates folding door sections in a maximum closed or un-folded position, FIG. 4 illustrates the door panels 10, 10*a* of folding door sections in the maximum open position, the door panels in a folded, parallel position next the wall.

Figure 6:
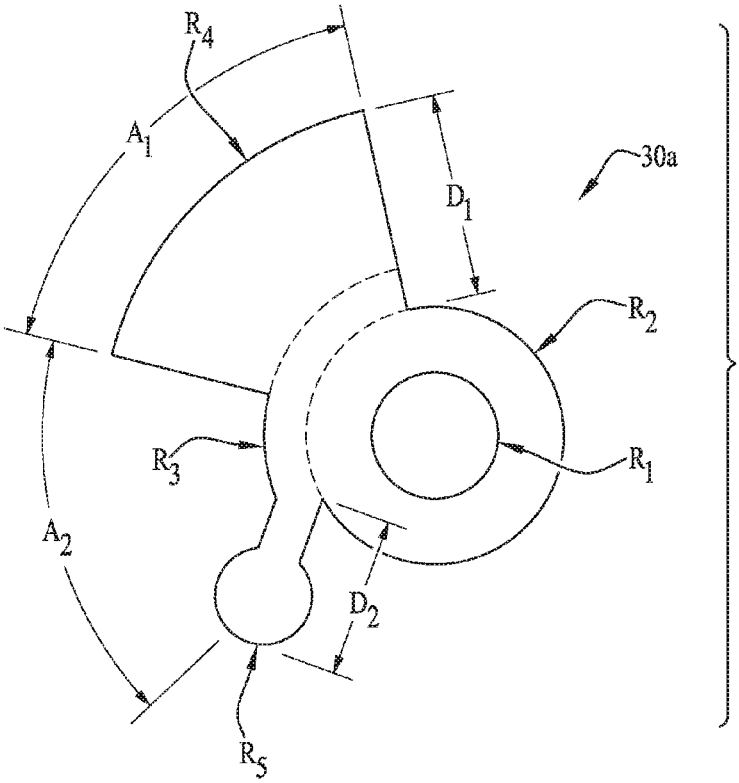
FIG. 6 is a top end plan view of the hinge knuckle unit of FIG. 5 showing example dimensions.

FIG. 6 illustrates the hinge knuckle 30*a* of FIGS. 3-5 and further provides an example size dimensions: radius R1 (of the central openings 32*a*)=0.065 inches; radius R2 (of the cylindrical central section 37*a*)=0.133 inches; radius R3=0.176 inches; radius R4=0.343 inches; radius R5=0.050 inches; length D1=0.210 inches; length D2=0.165 inches; angle A1 (of the wedge section 35*a*)=63.5°; and angle A2 (from the wedge section 35*a* to the bead 36*a*)=57.5°.

Figure 7:
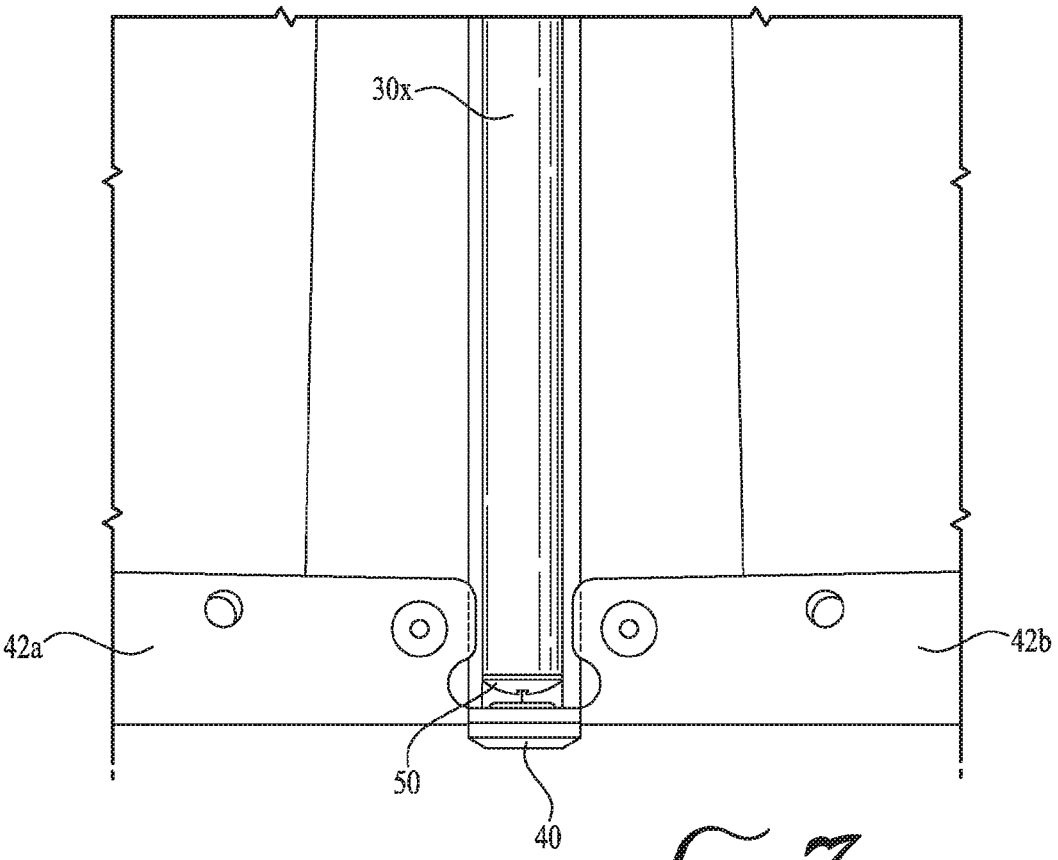
FIG. 7 is an isometric view of the bottom connection of the folding door assembly of FIG. 1.
Figure 8:
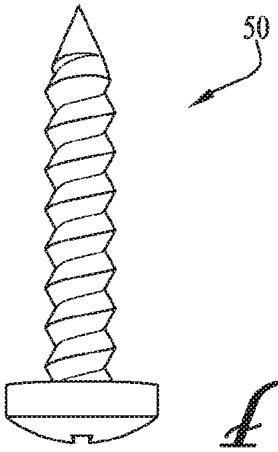
FIG. 8 is an isometric view of the retainer screw shown in FIG. 7.
Figure 9:
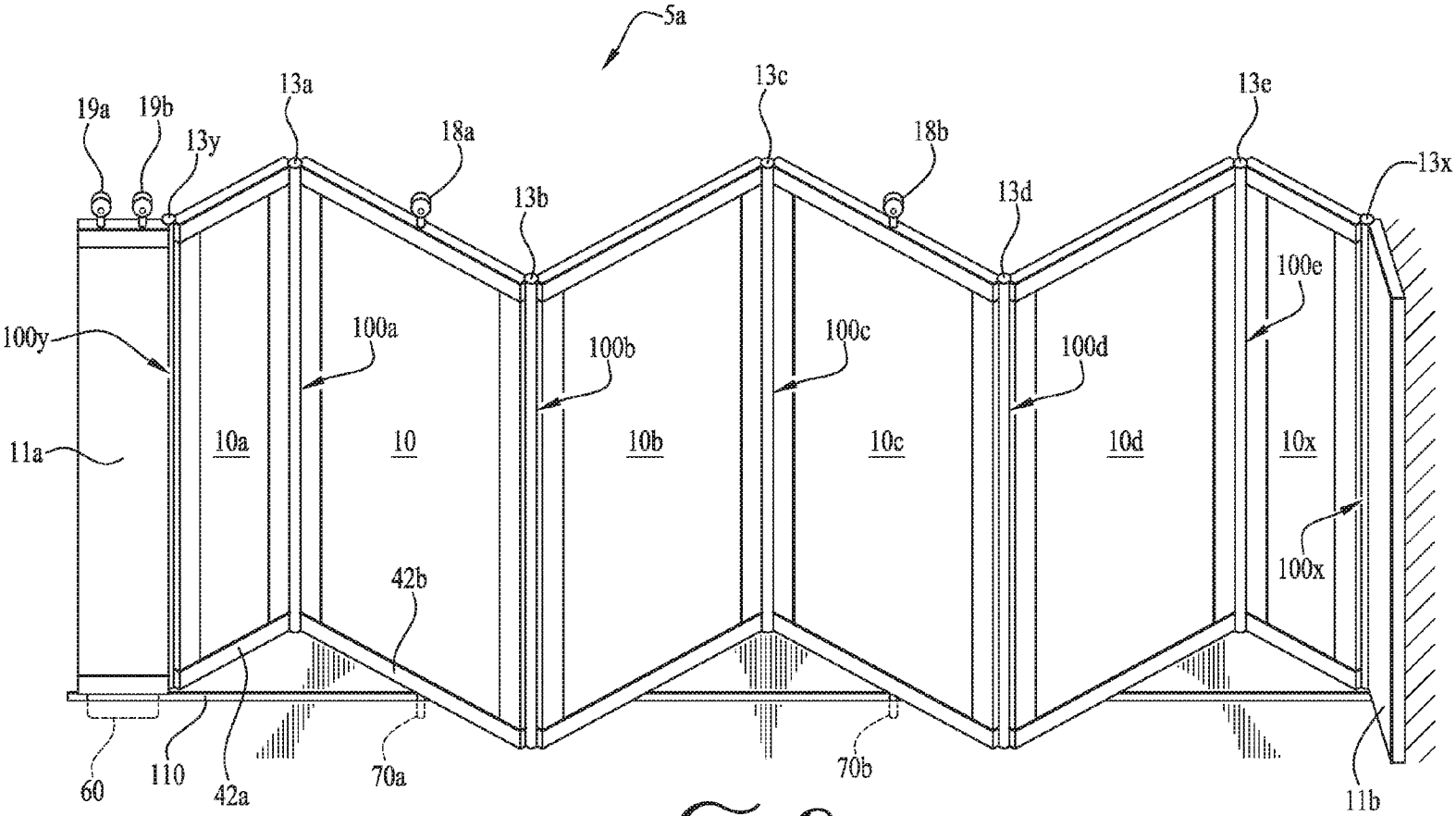
FIG. 9 is a full length isometric view of a four panel folding door assembly.

FIGS. 7-8 illustrate an example bottom connection of the folding door assembly of FIG. 1 according to an embodiment. The door panels have bottom cap pieces 42*a*, 42*b* (similar to the top cap pieces 12, 12*a*, 12*b*) that are hinged together via hinge 40 connecting the bottom cap pieces of an adjacent pair of panels. The hinge 40 is capped and does not extend into the central hinge mechanism. The hinge pin 33*a* "floats" in an installed relation through the central openings 32*a* in the hinge knuckles and thus is not secured directly to a structural member. A screw 50 (only the head of the screw is visible in FIG. 7, and further details of the screw 50 are shown in FIG. 8) is secured into the central opening of the bottom-most hinge knuckle 30*x* thus trapping the hinge pin 33*a* in place in operative position. In the event the screw 50 becomes dislodged from the knuckle unit 30*x*, the screw 50 is provided with a sufficient length shaft that the screw would slide down with its head into contact with the hinge 40 wherein a portion of the screw shaft still extending into the central opening of the hinge knuckle 30*x* and thus continue to retain the hinge pin 33*a* in place.

FIGS. 9-13 illustrate details and operation of a four panel door assembly 5*a*. The same elements in these figures are shown by common numerals from the previously described figures. The door assembly 5*a* includes four full size door panels 10, 10*b*, 10*c*, 10*d*, two half door panels 10*a*, 10*x*, a slide panel section 11*a* and a wall panel section 11*b* secured to the wall 7. The slide panel section 11*a* is supported and guided at the top on the ceiling track by mounting roller assemblies 19*a*, 19*b*, and at the bottom by slide tab 60 that is disposed in and slides along floor channel 110. Alternating panel sections also include a top mounting roller assembly (the panel section 10 includes a mounting roller assembly 18*a* and the panel section 10*c* includes mounting roller assembly 18*b*) and alternating panel sections also include a bottom slide post that engages the floor channel 110 (the panel section 10 includes slide post 70*a* and the panel section 10*c* includes slide post 70*b*). The panel sections are interconnected by hinge systems, as previously described, both at the top cap pieces (hinges 13*a-e*, 13*x*, 13*y*), at the bottom rails, and by central hinge assemblies (100*a-e*, 100*x*, 100*y* (each central hinge assembly comprising a central hinge pin and a plurality of stacked hinge knuckles such as assembly 100 of FIG. 18). Specifically, slide panel 11*a* is connected to half panel 10*a* by hinge knuckle assembly 100*y*, half panel 10*a* is connected to panel 10 by hinge knuckle assembly 100*a*, panel 10 is connected to panel 10*b* by hinge knuckle assembly 100*b*, panel 10*b* is connected to panel 10*c* by hinge knuckle assembly 100*c*, panel 10*c* is connected to panel 10*d* by hinge knuckle assembly 100*d*, panel 10*d* is connected to half panel 10*x* by hinge knuckle assembly 100*e*, and half panel 10*x* is connected to wall panel 11*b* by hinge knuckle assembly 100*x*.

Both elements of the central hinge assembly (the hinge knuckle and the hinge pin) are fabricated from hard, durable, strong material so that they resist forcible entry through the central hinge structure. Thus hinge pin 33*a* may be made of a suitable metal such as steel. The hinge knuckles 30*a*, 30*b* etc. may be fabricated from a strong, hard, plastic such as rigid vinyl (PVC) plastic or other suitable material such as metal (e.g., brass).

Thus, when the door is in its extended (un-folded) position of FIGS. 1, 2, 9 and 10, the joints on one side are protected by means of flanges 26*a*, 26*c* engaging the wedge 35*a*. On the other side of the door, the space between the panels is protected by the continuous barrier presented by hinge knuckles 30*a*, 30*b*, etc. mounted on (e.g., made of steel) hinge pin 33*a*. The door accordingly is protected against vandalism and entry by the application of force other than a force of door-destructive caliber.

Figure 14:
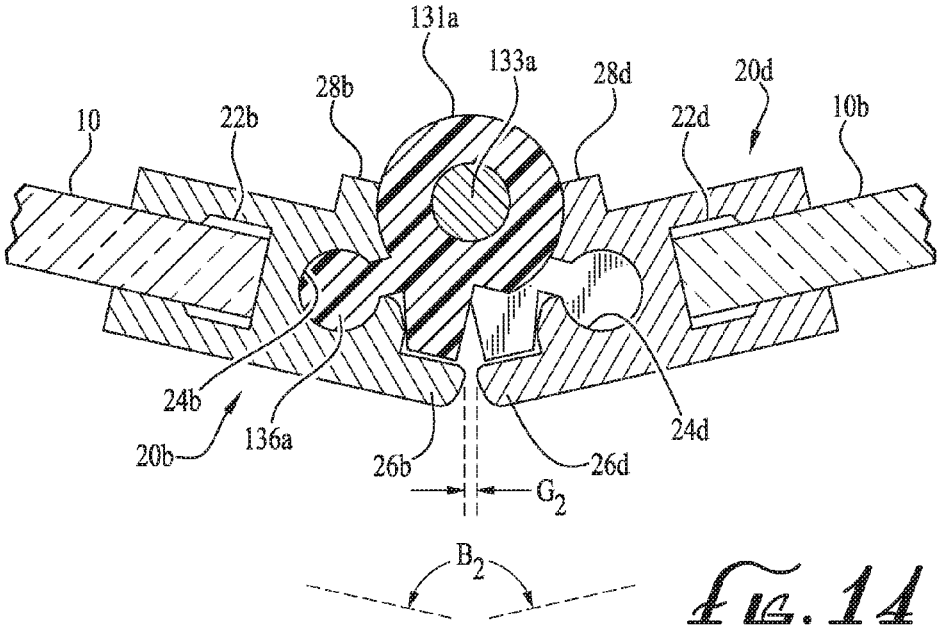
FIG. 14 is a partial cross-sectional view of a portion of the folding door assembly of FIG. 1, on an enlarged scale, with an alternate hinge knuckle unit.
Figure 15:
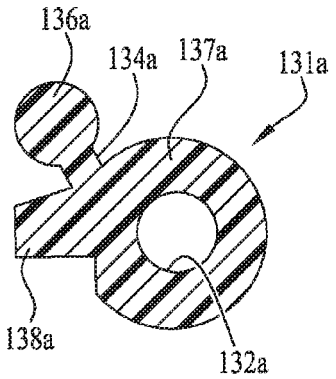
FIG. 15 is a top end plan view of the hinge knuckle unit of FIG. 14

FIGS. 14-15 illustrate an alternate hinge knuckle 131*a* as described in U.S. Pat. No. 4,922,987. The alternate hinge knuckle 131*a* includes a cylindrical central section 137*a* forming a central opening 132*a* and a longitudinally extending tongue 134*a* terminating in a bead 136*a* that nests within the longitudinal extending groove 24*b*. Multiple hinge knuckles are stacked to a desired (as previously described) and secured by central pin 133*a*. The alternate hinge knuckle 131*a* (hereinafter referred to as the "old hinge knuckle design" or the "old hinge knuckle configuration") does not include the outwardly extending wedge 35*a* of the hinge knuckle 30*a* of FIG. 5 and thus permits the adjacent door panels 10*a*, 10*b* to open to a larger angle B2 as shown in FIG. 14, and a smaller gap G2 between adjacent extending flanges 26*b*, 26*d* (the extending flanges 26*b*, 26*d* contacting each other to limit opening of the panels).

Each of the hinge knuckle assembles 100*a-e*, 100*x*, 100*y* may comprise the new design of the hinge knuckle 30*a* of FIG. 5, but a door assembly may comprise a combination of the hinge knuckle assemblies of different designs. The new hinge knuckle design 30*a* of FIG. 5 with the wedge 35*a* provides for stronger force resistance but permits a smaller extension angle B1 (see FIG. 3) than the extension angle B2 permitted by the old hinge knuckle design 131*a* (see FIG. 14). It has been determined that only smaller number of hinge assemblies are needed to be constructed with the new hinge knuckle design to achieve superior resistance performance, and thus most of the hinge assemblies may be constructed with the old hinge knuckle design to permit larger extension angles. For example, the door assembly 5*a* of FIG. 10 may be configured as set forth in the following Table A with the new hinge knuckle configuration arranged only on the inside hinge sections:

TABLE A

| Four Panel Door Assembly 5a | |
|---|---|
| Hinge Assembly | Hinge Knuckle Configuration |
| 100y | old |
| 100a | new |
| 100b | old |
| 100c | new |
| 100d | old |
| 100e | new |
| 100x | old |

Figure 10:
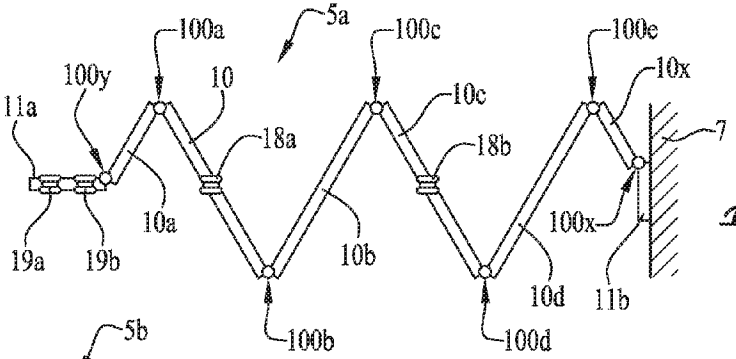
FIG. 10 is a top diagrammatic view of the four panel folding door assembly of FIG. 9 in the closed, un-folded, extended position.
Figure 10A:
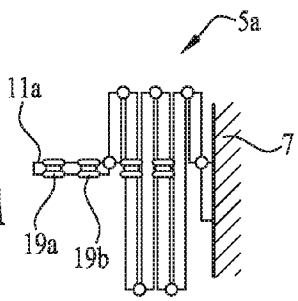
FIG. 10A is a top diagrammatic view of the four panel folding door assembly of FIG. 10 in the open, folded, contracted position

Alternately, for a door assembly 5*a* as in FIG. 10, the new hinge knuckle configuration may be disposed only on outside hinge sections as set forth in Table B:

TABLE B

| Four Panel Door Assembly 5a (alternate) | |
|---|---|
| Hinge Assembly | Hinge Knuckle Configuration |
| 100y | old |
| 100a | old |
| 100b | new |
| 100c | old |
| 100d | new |
| 100e | old |
| 100x | old |

Figure 16:
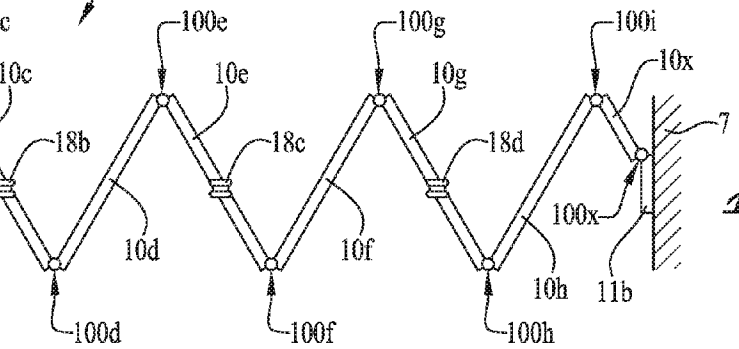
FIG. 16 is a top diagrammatic view of an eight panel folding door assembly.
Figure 17:
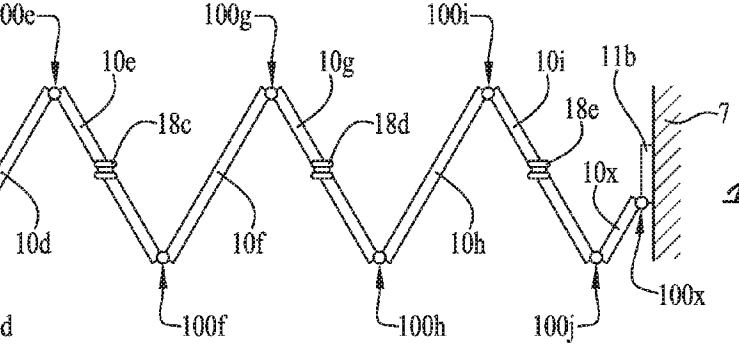
FIG. 17 is a top diagrammatic view of a nine panel folding door assembly.
Figure 11:
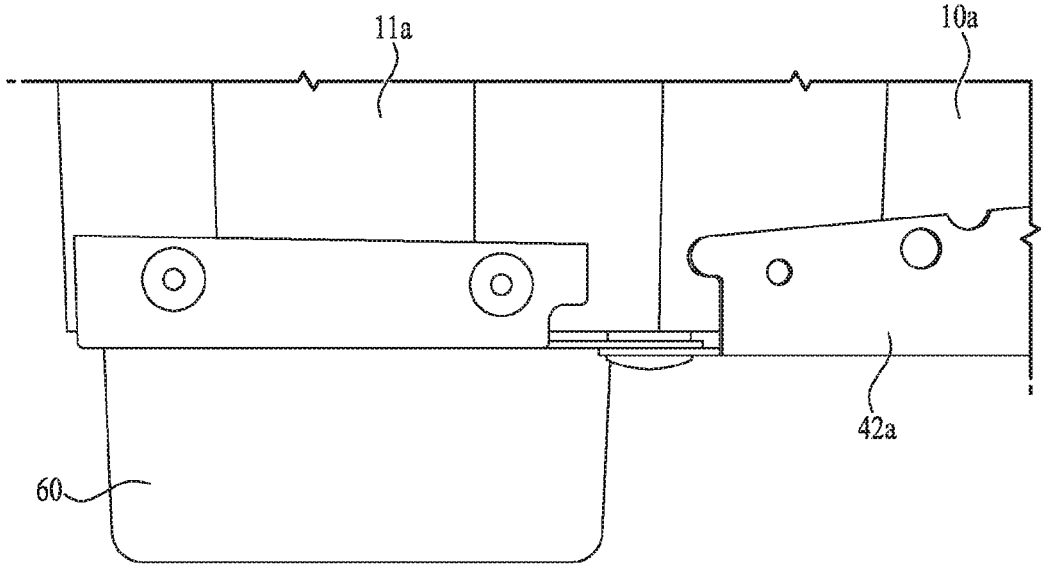
FIG. 11 is a front side perspective view of the slide plate section of the folding door assembly of FIG. 9, on an enlarged scale.
Figure 12:
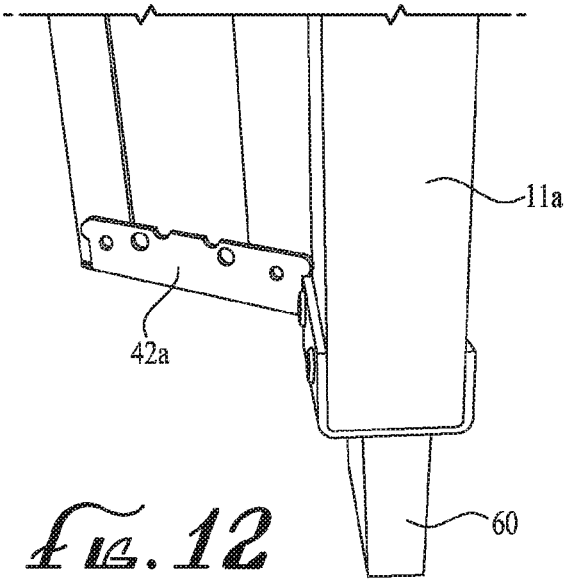
FIG. 12 is a left side perspective view of the slide plate section of FIG. 11.
Figure 13:
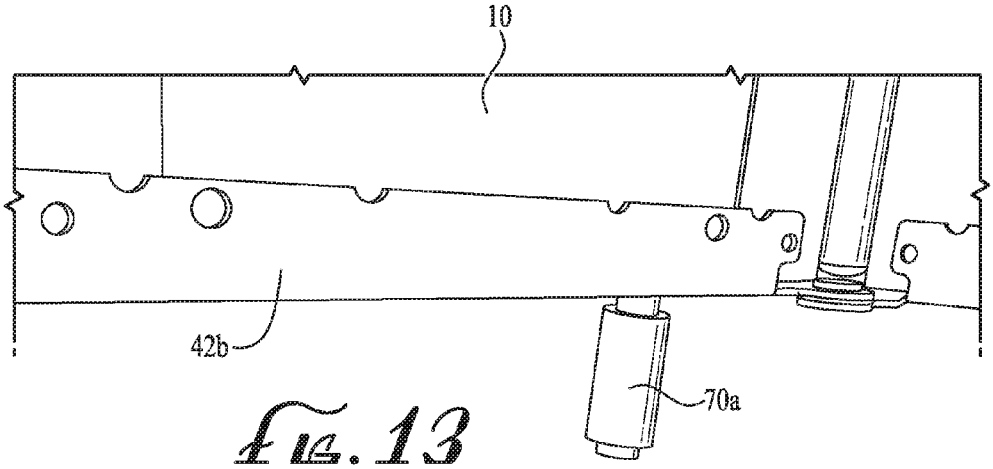
FIG. 13 is a front side perspective view of the slide post section of the folding door assembly of FIG. 9, on an enlarged scale.

FIGS. 16 and 17 illustrate larger size panel door assemblies. The eight panel door assembly 5*b* in FIG. 16 includes eight full size panels 10, 10*b*, 10*c*, 10*d*, 10*e*, 10*f*, 10*g*, 10*h*, half panel 10*a*, half panel 10*x*, slide panel 11*a*, and wall panel 11*b*. The panel sections are pivotally connected by hinge assemblies 100*a-i*, 100*x*, 100*y*. Alternating panel sections include a top mounting roller assembly (the panel section 10 includes a mounting roller assembly 18*a*, the panel section 10*c* includes mounting roller assembly 18*b*, the panel section 10*e* includes a mounting roller assembly 18*c*, the panel section 10*g* includes mounting roller assembly 18*d*) and each alternating panel sections (10, 10*c*, 10*e*, 10*g*) also includes a bottom slide post (such as slide post 70*a* in FIG. 13) that engages the floor channel 110.

The door assembly 5*b* of FIG. 16 may be configured entirely with the new style hinge knuckle 30*a*, but may alternately be configured with the new hinge knuckle configuration arranged on most of the inside ones of hinge assemblies, as set forth in the following Table C, or only on the outside (100*b*, 100*d*, 100*f*, 100*h*):

TABLE C

| Eight Panel Door Assembly 5b | |
|---|---|
| Hinge Assembly | Hinge Knuckle Configuration |
| 100y | old |
| 100a | old |
| 100b | old |
| 100c | new |
| 100d | old |
| 100e | new |
| 100f | old |
| 100g | new |
| 100h | old |
| 100i | old |
| 100x | old |

The nine panel door assembly 5*c* in FIG. 17 includes nine full size panels 10, 10*b*, 10*c*, 10*d*, 10*e*, 10*f*, 10*g*, 10*h*, 10*i*, half panel 10*a*, half panel 10*x*, slide panel 11*a*, and wall panel 11*b*. The panel sections are pivotally connected by hinge assemblies 100*a-j*, 100*x*, 100*y*. Alternating panel sections include a top mounting roller assembly (the panel section 10 includes a mounting roller assembly 18*a*, the panel section 10*c* includes mounting roller assembly 18*b*, the panel section 10*e* includes a mounting roller assembly 18*c*, the panel section 10*g* includes mounting roller assembly 18*d*, the panel section 10*i* includes mounting roller assembly 18*e*) and each alternating panel sections (10, 10*c*, 10*e*, 10*g*, 10*i*) also includes a bottom slide post that engages the floor channel 110.

The door assembly 5*c* of FIG. 17 may be configured with the new style hinge knuckle 30*a*, but may also include may be configured with the new hinge knuckle configuration arranged only on most of the inside hinge sections 100*c*, 100*e*, 100*g* as set forth in the following Table D:

TABLE D

| Nine Panel Door Assembly 5c | |
|---|---|
| Hinge Assembly | Hinge Knuckle Configuration |
| 100y | old |
| 100a | old |
| 100b | old |
| 100c | new |
| 100d | old |
| 100e | new |
| 100f | old |
| 100g | new |
| 100h | old |
| 100i | old |
| 100j | old |
| 100x | old |

Other combinations of old and new style hinge knuckles may be employed to provide a desired strength property (provided by the new design) or larger extension angle (provided by the old design).

Though the present invention has been set forth in the form of its preferred embodiments, it is nevertheless intended that modifications to the disclosed systems and methods may be made without departing from inventive concepts set forth herein.

The invention claimed is:

1. An accordion type folding door system comprising a plurality of adjacent panels arranged vertically and side-by-side, each panel including a top end having an upper margin, and a bottom end having a lower margin;

a hinge assembly disposed between and interconnecting a pair of adjacent panels, each of the pair of adjacent panels including a side edge having longitudinal groove and an extension flange, wherein the hinge assembly comprises a hinge pin, a plurality of hinge knuckles disposed vertically end-to-end in an alternating arrangement on the hinge pin, at least one of the hinge knuckles comprising a tubular central opening for accepting the hinge pin, an outwardly extending tongue for connecting to a corresponding longitudinal groove in an adjacent panel in a tongue and groove connection, and an outwardly flared wedge that extends between and beyond the extension flanges of the panels, whereby the wedge cooperates with, and respective outer surfaces of the wedge directly contact, the extension flanges to limit angular un-folding extension of the pair of adjacent panels to a maximum desired angle.

2. A system according to claim 1 wherein the plurality hinge knuckles comprise a first partial length hinge knuckle disposed at a bottom of the hinge pin, a second partial length hinge knuckle disposed at a top of the hinge pin, and seven or eight full length hinge knuckles disposed on the hinge pin between the first and second partial length hinge knuckles.

3. A system according to claim 1 further comprising a track positioned across a space to be secured;

mounting roller assemblies disposed on upper margins of selected panels for mounting the panels on the track.

4. A system according to claim 1 further comprising upper and lower hinges mounted at top and bottom margins of each panel for hinging the adjacent panels together.

5. A method of operation for an accordion type folding door system, comprising arranging a plurality of adjacent panels arranged vertically and side-by-side, each panel including a top end having an upper margin, and a bottom end, a hinge assembly disposed between and interconnecting a pair of adjacent panels, each of the pair of adjacent panels including a side edge having longitudinal groove and an extension flange;

forming the hinge assembly via a plurality of hinge knuckles disposed vertically end-to-end in an alternating arrangement on a hinge pin, at least one of the hinge knuckles comprising a tubular central opening for accepting the hinge pin, an outwardly extending tongue for connecting to a corresponding longitudinal groove in an adjacent panel in a tongue and groove connection, and an outwardly flared wedge;

extending the outwardly flared wedge between and beyond the extension flanges of the panels for limiting angular un-folding extension of the pair of adjacent panels to a maximum desired angle via the wedge cooperating with, and respective outer surfaces of the directly contacting, the extension flanges.

6. An accordion type folding door system comprising a plurality of adjacent panels arranged vertically and side-by-side, each panel including a top end having an upper margin, and a bottom end having a lower margin;

a plurality of hinge assemblies including (a) first hinge assembly disposed between and interconnecting a first pair of adjacent panels, each of the first pair of adjacent panels including a side edge having a longitudinal groove and an extension flange and (b) a second hinge assembly disposed between and interconnecting a second pair of adjacent panels, each of the second pair of adjacent panels including a side edge having a longitudinal groove and an extension flange, wherein the first hinge assembly comprises a first hinge pin, a plurality of first hinge knuckles disposed vertically end-to-end in an alternating arrangement on the hinge pin, wherein each of the first hinge knuckles comprises a first hinge knuckle configuration comprising a tubular central opening for accepting the first hinge pin, an outwardly extending tongue for connecting to a corresponding longitudinal groove in an adjacent panel in a tongue and groove connection, and an outwardly flared wedge that extends between and beyond the extension flanges of the panels, whereby the wedge cooperates with, and respective outer surfaces of the wedge directly contact the extension flanges to limit angular un-folding extension of the first pair of adjacent panels to a maximum desired angle, wherein the second hinge assembly comprises a second hinge pin, a plurality of second hinge knuckles disposed vertically end-to-end in an alternating arrangement on the hinge pin, wherein each of the second hinge knuckles comprises a second hinge knuckle configuration comprising a tubular central opening for accepting the second hinge pin, an outwardly extending tongue for connecting to a corresponding longitudinal groove in an adjacent panel in a tongue and groove connection, and without an outwardly flared wedge that extends between and beyond the extension flanges of the panels.

7. A system according to claim 6 wherein the plurality of first hinge knuckles comprises a first partial length hinge knuckle disposed at a bottom of the first hinge pin, a second partial length hinge knuckle disposed at a top of the first hinge pin, and seven or eight full length hinge knuckles disposed on the first hinge pin between the first and second partial length hinge knuckles.

* * * * *